US009124032B2

(12) United States Patent
Arakelian

(10) Patent No.: US 9,124,032 B2
(45) Date of Patent: Sep. 1, 2015

(54) ELECTRICAL CONNECTOR WITH MAGNET

(75) Inventor: Richard Arakelian, Kenthurst (AU)

(73) Assignee: ARK Corporation Pty Ltd, Arndell Park (AU)

( * ) Notice: Subject to any disclaimer, the term of this patent is extended or adjusted under 35 U.S.C. 154(b) by 220 days.

(21) Appl. No.: 13/821,899

(22) PCT Filed: Apr. 21, 2011

(86) PCT No.: PCT/AU2011/000484
§ 371 (c)(1),
(2), (4) Date: May 21, 2013

(87) PCT Pub. No.: WO2012/031312
PCT Pub. Date: Mar. 15, 2012

(65) Prior Publication Data

US 2013/0224978 A1 Aug. 29, 2013

(51) Int. Cl.

| | |
|---|---|
| ***H01R 13/629*** | (2006.01) |
| ***H01R 4/36*** | (2006.01) |
| ***H01R 13/17*** | (2006.01) |
| ***H01R 13/405*** | (2006.01) |

(52) U.S. Cl.
CPC ..... *H01R 13/629* (2013.01); *H01R 4/36* (2013.01); *H01R 13/17* (2013.01); *H01R 13/405* (2013.01)

(58) Field of Classification Search
CPC ..... B60D 1/64
USPC ..... 439/40, 35, 814; 280/422; 248/206.5
See application file for complete search history.

(56) References Cited

U.S. PATENT DOCUMENTS

| | | | | | |
|---|---|---|---|---|---|
| 2,024,734 | A | * | 12/1935 | Hoskins | 439/501 |
| 2,474,942 | A | * | 7/1949 | Hawkins | 439/40 |
| 2,709,245 | A | * | 5/1955 | Schneider | 439/40 |
| 2,718,540 | A | * | 9/1955 | Betz | 429/96 |
| 2,820,112 | A | * | 1/1958 | Lupu | 191/12.2 R |
| 3,176,257 | A | * | 3/1965 | Introvigne | 439/528 |
| 3,227,802 | A | * | 1/1966 | Pressley, Jr. | 174/650 |
| 3,553,627 | A | * | 1/1971 | Gerber | 439/40 |
| 3,577,115 | A | * | 5/1971 | Whitright | 439/528 |
| 3,613,044 | A | * | 10/1971 | Rarick | 439/528 |
| 3,773,969 | A | * | 11/1973 | Geisel | 174/67 |
| 4,017,136 | A | * | 4/1977 | Sasgen | 439/503 |
| 4,106,834 | A | * | 8/1978 | Horowitz | 439/142 |
| 4,278,226 | A | * | 7/1981 | Horowitz | 248/314 |
| 4,358,082 | A | * | 11/1982 | Reeves | 248/75 |

(Continued)

FOREIGN PATENT DOCUMENTS

| | | |
|---|---|---|
| CN | 101499589 | 8/2009 |
| JP | 2009-301891 | 12/2009 |

OTHER PUBLICATIONS

PCT International Preliminary Report on Patentability for PCT/AU2011/000484 mailed Nov. 16, 2012.

*Primary Examiner* — Neil Abrams
(74) *Attorney, Agent, or Firm* — Colin P. Cahoon; Shaukat A. Karjeker; Carstens & Cahoon, LLP

(57) ABSTRACT

A rolled terminal (50) for an electrical connector has a first portion (58) formed of a rolled sheet defining a bore for receiving an electrical wire, and a first aperture (62) in the wall of the first portion (58) for receiving a screw for clamping the wire between the screw and the wall of the first portion. Also included is a plug attached by cable to a towed vehicle, the plug associated with a magnet to enable it to be secured to the towed vehicle when the plug is not in use.

20 Claims, 8 Drawing Sheets

(56) References Cited

U.S. PATENT DOCUMENTS

| | | | | | |
|---|---|---|---|---|---|
| 4,366,965 | A | * | 1/1983 | Rhodes | 280/421 |
| 4,738,641 | A | * | 4/1988 | Eversole, Jr. | 439/528 |
| 4,940,427 | A | * | 7/1990 | Pearson | 439/501 |
| 5,253,891 | A | * | 10/1993 | Carlin et al. | 280/422 |
| 5,308,253 | A | * | 5/1994 | Maki | 439/148 |
| 5,380,209 | A | * | 1/1995 | Converse, Jr. | 439/35 |
| 5,593,170 | A | * | 1/1997 | Chiu | 280/422 |
| 5,607,221 | A | * | 3/1997 | Justus | 362/485 |
| 5,630,728 | A | * | 5/1997 | Watters, Jr. | 439/528 |
| 5,669,471 | A | * | 9/1997 | Unze | 191/12.2 R |
| 5,732,966 | A | * | 3/1998 | Menard et al. | 280/422 |
| 5,765,848 | A | * | 6/1998 | Silvey | 280/422 |
| 5,954,520 | A | * | 9/1999 | Schmidt | 439/39 |
| 5,997,320 | A | * | 12/1999 | DeMello | 439/148 |
| 6,019,386 | A | * | 2/2000 | Morelock | 280/507 |
| 6,083,016 | A | * | 7/2000 | Waynick, Sr. | 439/135 |
| 6,089,907 | A | * | 7/2000 | Shoblom | 439/528 |
| 6,685,502 | B2 | * | 2/2004 | Wheeler | 439/501 |
| 6,705,880 | B2 | * | 3/2004 | Rhude | 439/144 |
| 6,902,180 | B2 | * | 6/2005 | Baginski | 280/420 |
| 6,971,883 | B1 | | 12/2005 | Ridge | |
| 7,338,314 | B2 | * | 3/2008 | Thai | 439/528 |
| 7,404,591 | B2 | * | 7/2008 | Bender | 296/164 |
| 7,717,751 | B2 | | 5/2010 | Bellotto et al. | |
| 7,744,375 | B2 | * | 6/2010 | Huang et al. | 439/35 |
| 7,955,085 | B2 | * | 6/2011 | Rotenberg et al. | 439/35 |
| 2007/0278995 | A1 | * | 12/2007 | Batdorff et al. | 320/107 |
| 2008/0266762 | A1 | * | 10/2008 | Ho et al. | 361/679 |

* cited by examiner

ELECTRICAL CONNECTOR WITH MAGNET

FIELD OF INVENTION

This invention relates to electrical connectors and has particular relevance to connectors used with vehicle trailers. However the invention is not limited to use with vehicle trailers.

BACKGROUND

Trailers for road vehicles have various electrical lights, such as brake, tail lights and indicator lights. These are powered and controlled from the tow vehicle.

The electrical connection from the trailer to the tow vehicle is usually via a detachable multi strand cable. Typically the tow vehicle has a socket mounted at its rear into which a plug on the cable of the trailer is inserted. To allow for movement of the trailer relative to the tow vehicle the cable cannot be taut and there must be extra cable, i.e. some slack, to accommodate this relative movement.

When the trailer is detached from the tow vehicle the plug is removed from the socket and then hangs from the loose cable. The plug and cable can present a safety hazard when manoeuvring a trailer. For example a person manoeuvring the trailer may trip on the cable. In addition, the plug and cable may be damaged or contaminated with debris, such as dirt. Most single axle trailers are balanced so the trailer hitch rests on the ground when unloaded. The cable and plug are at the hitch end and commonly either rest on the ground, where they can be contaminated or can be crushed by the trailer hitch.

Electrical connectors are typically provided in one or two forms. In one form the connector is in a fully assembled form, with the cable permanently attached to the electrical pins or sockets and, usually encased in a moulded shell. The other form is for attachment to a cable at a later date. Permanently attached cables typically are connected to rolled terminals that are crimped to the electrical wire. Connectors for which the cable is attached later are typically provided with terminals formed of solid metal that has been machined to have a bore for the wire and a threaded side aperture for a screw. Whilst these allow a cable to be attached and detached they are more expensive than rolled terminals.

SUMMARY OF THE INVENTION

In one broad form the invention provides an electrical connector for a towed vehicle, the connector including securing means for temporarily securing the electrical connector to the towed vehicle.

In one form the securing means includes at least one first magnet, whereby the electrical connector may be secured by the magnet to a magnetic part of the towed vehicle.

At least one second magnet may be provided for permanent mounting on the towed vehicle for magnetic connection with the at least one first magnet.

The securing means may comprise at least one mechanical securing means to secure the connector to the towed vehicle. The at least one mechanical securing means may comprise a clip, plug or socket that interacts with a corresponding complementary structure on the towed vehicle. There may be a clip or other structure on the towed vehicle that engages the connector.

Where the electrical connector has a plug portion the complementary structure may be a secondary socket mounted on the towed vehicle into which the plug portion is inserted and secured. Where the electrical connector has a socket portion the complementary structure may be a secondary plug mounted on the towed vehicle over which the socket portion is engaged with and secured.

The invention, in another form, provides a rolled terminal for an electrical connector. The rolled terminal has a first portion formed of a rolled sheet defining a bore for receiving an electrical wire and a first aperture in the wall of the first portion for receiving a screw for clamping the wire between the screw and the wall of the first portion.

The first aperture may be sized so the screw is a clearance fit in the aperture. Alternatively, the first aperture may be an interference fit. The material of the wall and the size of the first aperture may be chosen so that the thread of the screw engages the first aperture in a threaded manner. The first aperture may be deformed by the thread of the screw to present a complementary thread or the first aperture may be provided with a complementary thread.

In another form the rolled terminal of the invention is located in a plastics carrier that has a second aperture that aligns with the first aperture. The second aperture may be a clearance fit with the screw or may engage the thread of the screw.

The second aperture may be provided with a thread with which the screw engages. This may be by way of a separately threaded component, such as a nut, embedded in the plastics material. Alternatively the second aperture may be sized so the screw forms a thread on first use. Alternatively the aperture may be formed with a thread for the screw.

Accordingly, the invention also provides an electrical connector including at least one rolled terminal located in a carrier, the at least one a rolled terminal having a first portion formed of a rolled sheet defining a bore for receiving an electrical wire and a first aperture in the wall of the first portion for receiving a screw; a second aperture in the carrier aligned with the first aperture and a screw located in the second aperture for clamping the wire between the screw and the wall of the first portion.

The connector may be a plug or a socket. The at least one rolled terminal may include at least one plug type rolled terminal, at least one socket type rolled terminal or both at least one plug type rolled terminal and at least one socket type rolled terminal.

The screw may engage one or both of the first and second apertures. Preferably the screw only engages either the first or the second aperture.

Preferably the rolled terminal includes means to prevent or limit rotation about a longitudinal axis when mounted in the carrier. The means to prevent or limit rotation is preferably a part of the first portion that has a non circular cross section. In one form a part of the wall of the first portion is pressed outwards. Preferably the carrier has a complementary recess into which the part of the wall extends. This enables the terminal to be correctly aligned in the carrier recess so that the first and second apertures align.

When the screw is holding the wire in the terminal the screw also prevents the terminal being pulled or pushed out of the carrier.

DETAILED DESCRIPTION OF PREFERRED AND OTHER EMBODIMENTS

Referring to FIGS. 1 to 4 there is shown an electrical connector 10. The connector 10 is typically used on trailers (and other towed vehicles such as caravans and horse floats) to connect the electrical system of the trailer to the electrical system of a tow vehicle. The connector is connected to a multi strand cable 12. In this implementation the connector is a moulded plug with the cable 12 connected to connector terminals (pins and sockets) 14 prior to moulding of the shell 16 of the connector 10. The connector may be a socket type connector.

The connector 10 has a magnet 18 secured in the shell 16. The magnet 18 may be secured by moulding the shell around the magnet during manufacture or, less preferred, by providing the shell with a recess and gluing or otherwise securing the magnet to the shell post manufacture.

Figure 1:
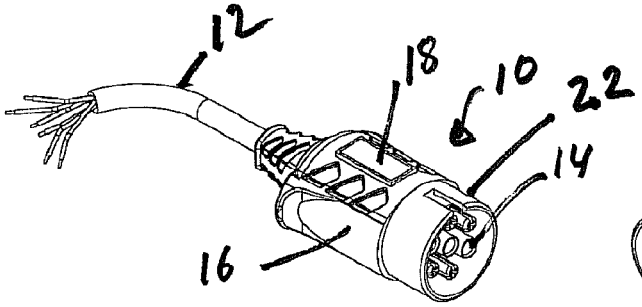
FIG. 1 is a perspective view from below of a first implementation of the invention.
Figure 5:
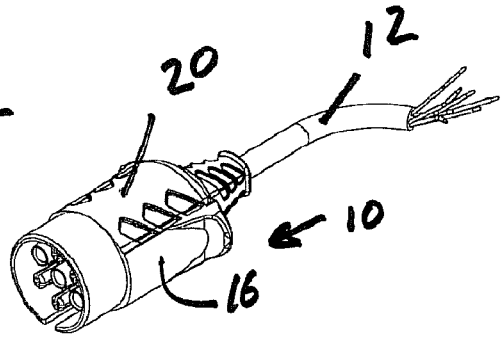
FIG. 5 is a perspective view from above of a first implementation of the invention.
Figure 4:
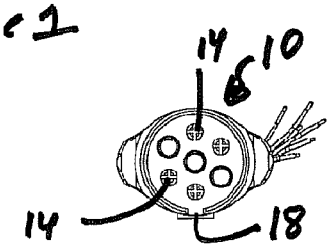
FIG. 4 is a front end view of a first implementation of the invention.
Figure 2:
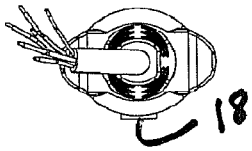
FIG. 2 is a rear end view of the first implementation of the invention.
Figure 3:
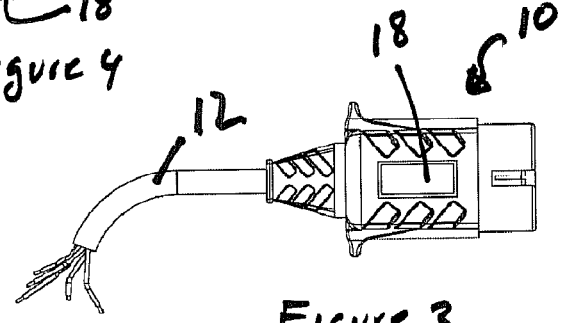
FIG. 3 is a view from below of the first implementation of the invention.

As seen in FIG. 2 the magnet is provided on the bottom of the connector. If desired a second magnet may be provided on the top 20 of the shell 16.

Figure 6:
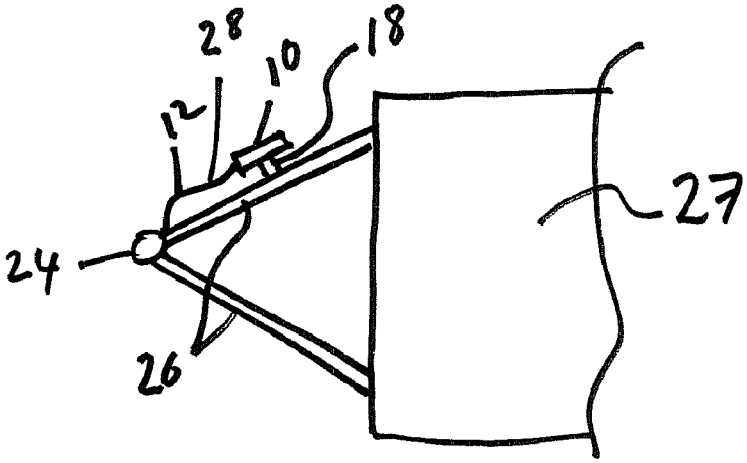
FIG. 6 is a schematic plan view of a trailer incorporating the first implementation of the invention.
Figure 7:
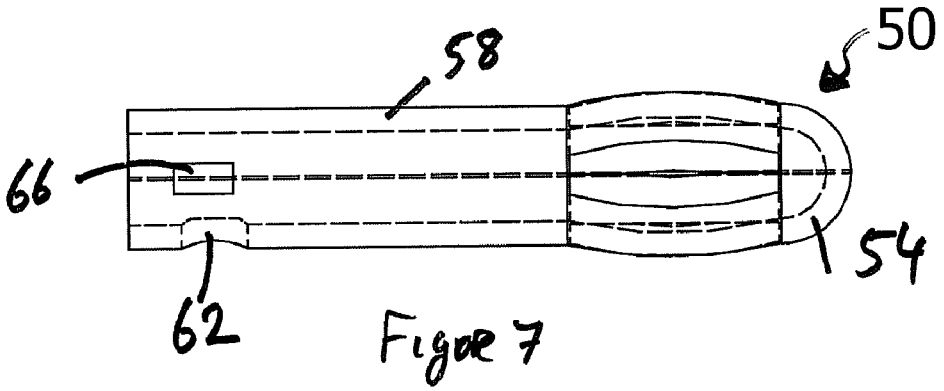
FIG. 7 is a top view of a second implementation of the invention.
Figure 8:
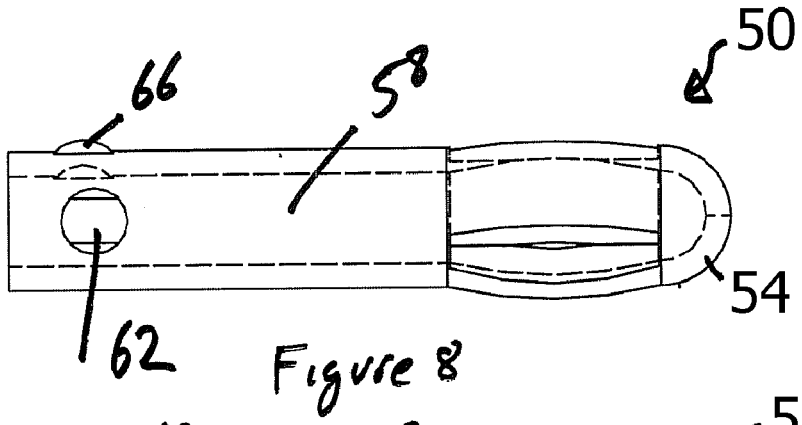
FIG. 8 is a side view of a second implementation of the invention.
Figure 9:
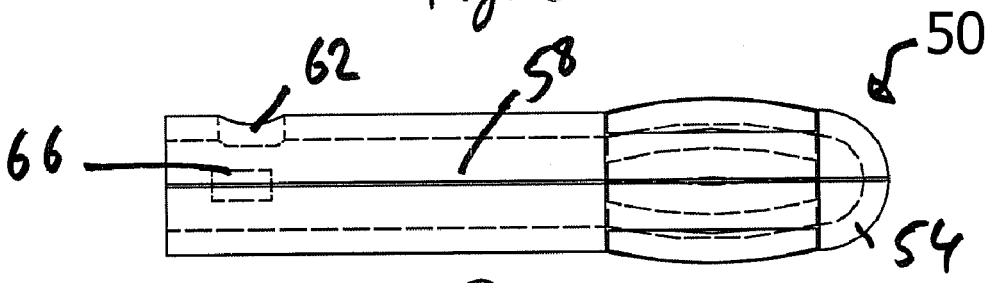
FIG. 9 is a bottom view of a second implementation of the invention.
Figure 10:
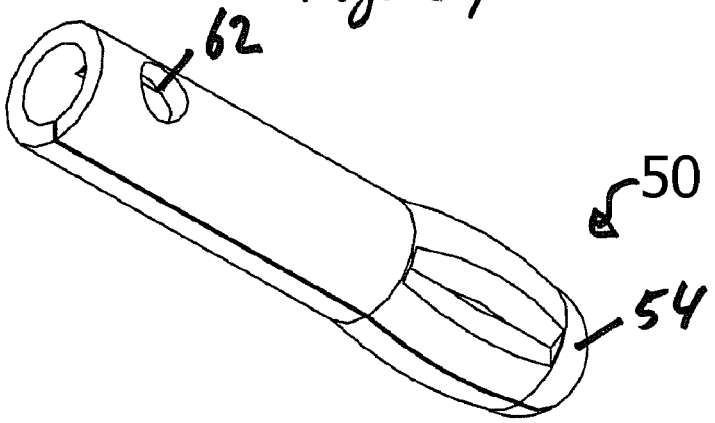
FIG. 10 is a perspective view of a second implementation of the invention.
Figure 11:
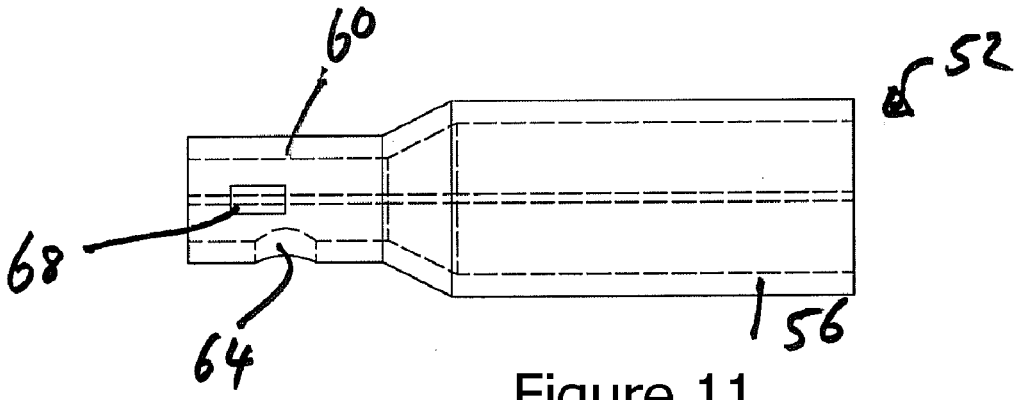
FIG. 11 is a top view of a third implementation of the invention.
Figure 12:
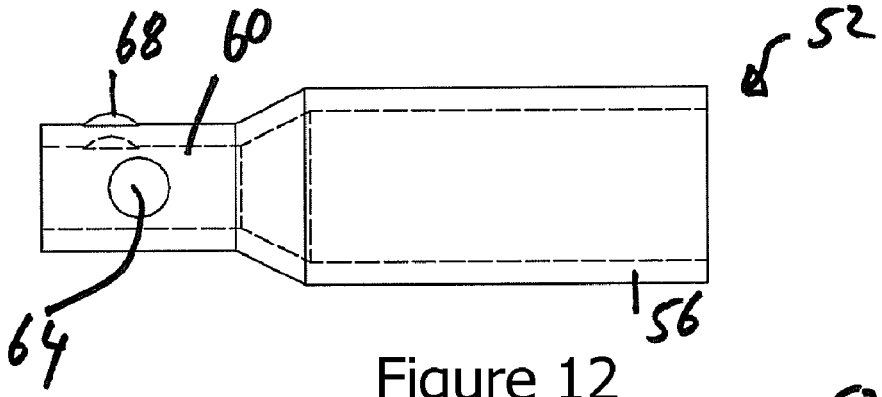
FIG. 12 is a side view of the third implementation of the invention.
Figure 13:
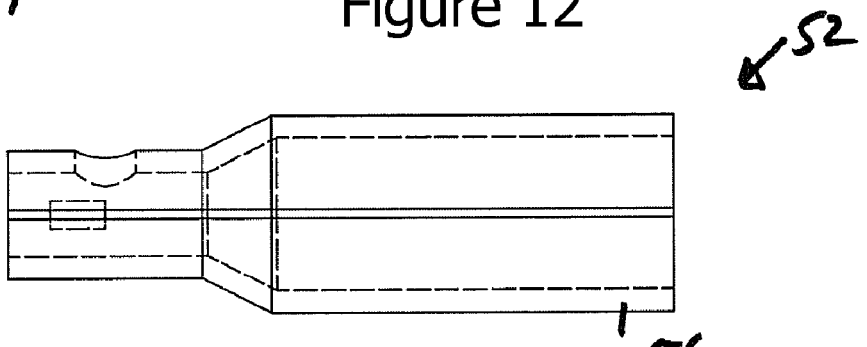
FIG. 13 is a bottom view of the third implementation of the invention.
Figure 14:
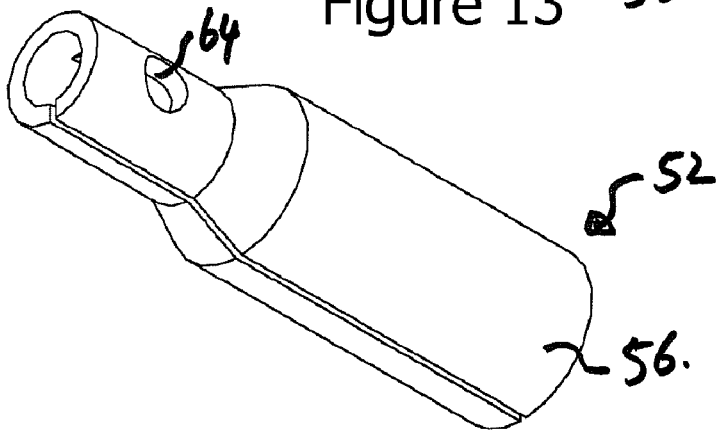
FIG. 14 is a perspective view of the third implementation of the invention.

In use the plug portion 22 of the connector 10 may be inserted as normal into a corresponding socket mounted on a tow vehicle. When the trailer is not connected to the tow vehicle the connector may be temporarily connected to part of the structure of the trailer, as shown in FIG. 6. As seen in FIG. 6, a typical trailer has a hitch portion 24 and one or two draw bars 26, which connect the hitch portion 24 with the rest of the trailer 27. The draw bars are typically steel and so are magnetic. Typically the cable 12 is secured to the draw bars and has a free end portion 28. In prior art systems this allows the connector 10 to hang and, potentially, drag on the ground or trip someone up.

As seen in FIG. 6 the connector may be attached to one of the steel draw bars 26 using the magnet 18. The connector may be attached to the draw bar 26 remote from the hitch portion so the cable 12 is reasonably taut. The connector 10 is thus secured and does not drag on the ground, where it can be damaged or the pins contaminated by dirt and the cable 12 is also secured, so reducing the risk of a person tripping or otherwise tangling with the cable. If the connector is contaminated by dirt this can cause a bad electrical connection between the connector and the tow vehicle socket. This can cause one of more of the trailer vehicle lights to be inoperative, which is a safety issue. Dirt contamination can also cause difficulty in the mechanical connection and/or disconnection of the connector and socket.

When the trailer is next used the user merely pulls the connector 10 away from the draw bar 26.

The connector 10 need not be a moulded connector and may be formed with a multipart shell that is assembled around the cable 12 and electrical connectors after electrical connection of the cable to the pins.

Paint on the trailer may result in the magnetic attractive force being marginal or insufficient to secure the connector to the trailer. Accordingly, a second magnet may be provided, preferably in a suitable mounting, for permanent attachment to the trailer so as to provide more secure attachment. When the connector 10 is to be attached to the trailer the user merely connects the first magnet on the connector 10 with and second magnet on the trailer together.

Whilst provision of one or more magnets on the connector is the preferred way of securing the connector to the trailer, other arrangements may be used.

The shell of the connector may be provided with a clip or other structure that engages a corresponding structure on the trailer, or vice versa. Accordingly the trailer may include a clip into which a portion of the shell is received or the clip may be received in a portion of the shell The connector in FIGS. 1 to 5 is a plug connector that connects to a corresponding socket on a tow vehicle. The trailer may be provided with a similar socket into which the plug portion of the connecter is inserted when not in use. Preferably such a socket is spaced from the hitch portion so as to reduce the slack in the cable. Where the connector is a socket a corresponding plug portion may be mounted on the trailer.

Referring to FIGS. 7 to 14 there are shown terminals 50 and 52 according to a second aspect of the invention. The terminal 50 is a pin adapted to be inserted into complementary socket terminal 52. The pin 50 includes a connection portion 54, which connects with connection portion 56 of socket 52.

The pin terminal 50 has a wire connection portion 58 for receiving an electrical wire or cable. Similarly the socket terminal 52 has wire connection portion 60 for receiving an electrical wire or cable.

The pin and socket terminals 50, 52 are formed from sheet metal that has been rolled into a cylindrical form, rather than from a solid piece of metal that has been machined as appropriate.

The socket portions 58, 60 have an aperture 62, 64, respectively, that is to allow a screw to pass into the interior of the connection portion and sandwich a cable of wire within between the screw and the opposing wall of the connection portion.

The terminals 50 and 52 used with the plug (and corresponding socket) of FIGS. 1 to 6 are relatively large and may be formed of relatively thick sheet metal. A thickness of about 0.8 mm may be used. A thread is formed on the apertures 62 and 64 with which the screw engages. However, as explained later with reference to another implementation, the screw threads on the apertures 62, 64 are not essential.

The connection portions 58, 60 are provided with an anti rotation outer surface. In this implementation the connection portions are generally cylindrical but have a portion of the wall pressed outwards to form protrusions 66, 68.

The terminals 50 and 52 may be used in any electrical connector requiring the ability to attach or detach electrical wires. The terminals may be used in a magnetic connector formed of a two part shell.

Figure 15:
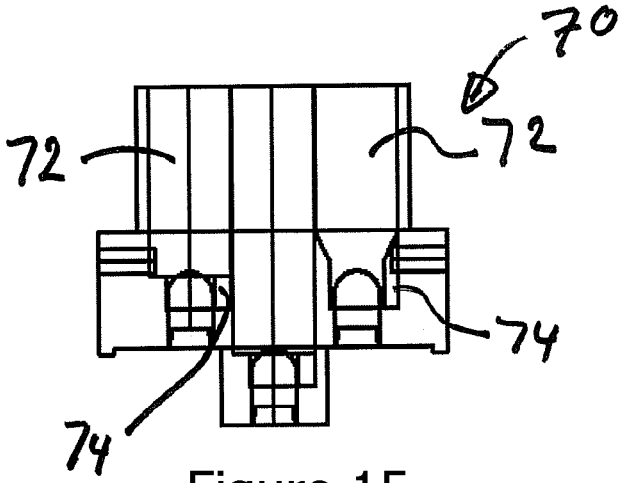
FIG. 15 is a cross sectional view of a carrier for the second and third implementations of the invention.
Figure 16:
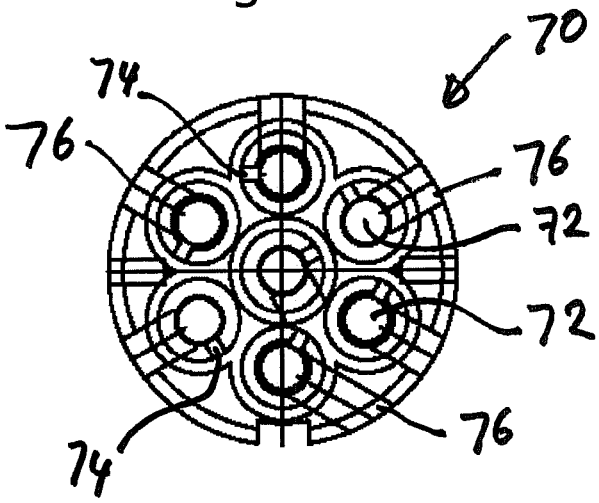
FIG. 16 is a plan view of the carrier of FIG. 16.
Figure 17:
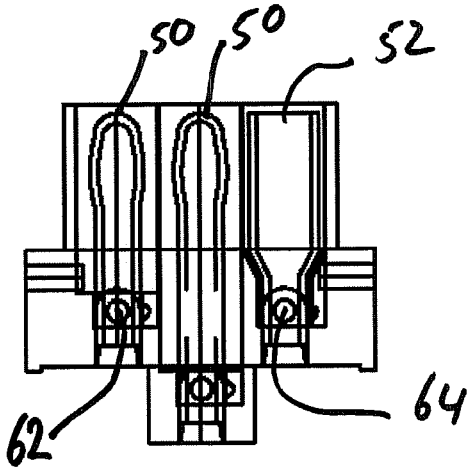
FIG. 17 is a cross sectional view of the carrier of FIG. 16 with the second and third implementations of the invention.
Figure 18:
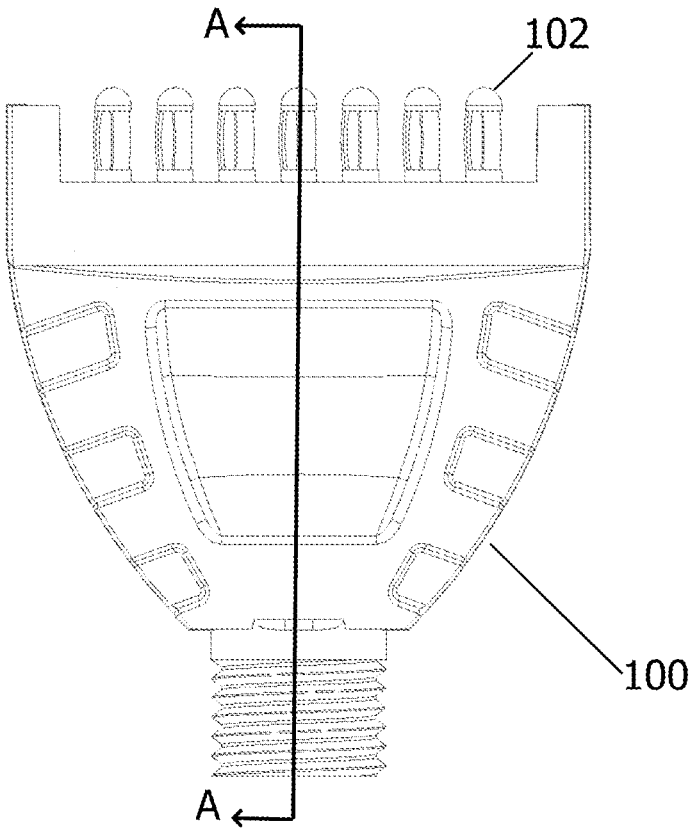
FIG. 18 is plan view of a connector according to another implementation of the invention.
Figure 19:
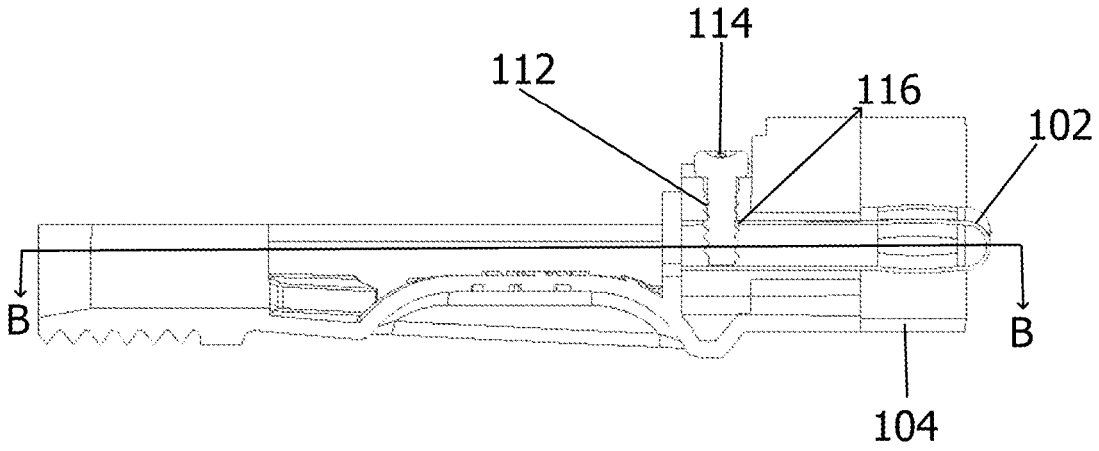
FIG. 19 is an axial cross sectional view of part the connector of FIG. 18 taken along line AA of FIG. 18.

Referring to FIGS. 15 to 17 there is shown a terminal carrier 70 that carries pin terminals 50 and socket terminals 52. The carrier 70 has through bores 72 in which the terminals 50, 52 are received. Each through bore 72 has a recess 74 into which the protrusions 66, 68 extend, thus locating the terminals and preventing rotation about their longitudinal axes.

Each through bore 72 also has a radially extending opening 76 that aligns with the apertures 62, 64. The recess 74 and protrusions 66, 68 align the apertures 62, 64 on the terminals with the corresponding opening 76. The openings 76 extend through the carrier and are open at the exterior of the carrier. Screws not show are located in the openings 76 and extend into the respective connection portion of the terminals. The threads of the screws engage the surface of the openings and/or the surface of the apertures 62, 64 and are screwed inwards to trap wires (not shown) between themselves and the opposing wall of the terminal.

In this implementation preferably openings 76 are oversize and the thread of the screws does not engage the material of the carrier 70. If desired the openings 76 may be sized so the thread of the screws does engage the material of the carrier 70. The carrier may be formed with a complementary thread on the openings 76. However, if an appropriate material is used for the carrier the screw may cut a thread on first use.

Once the screws are inserted into the terminals 50, 52, the terminals are retained in the carrier by the screws being located in the openings 76. Axial force applied to the terminal, such as when connecting and disconnecting the plug and socket is transferred from the terminal to the carrier via the screw and so pull out or push out of the terminals cannot occur.

If desired the carrier may be provided with separate threaded components within the openings 76 with which the screws engage. If such components are used these may be threaded metal nuts or similar, preferably embedded in the material of the carrier during manufacture.

A flat plug 100 according to another implementation of the invention is shown in FIGS. 18 to 21. The flat plug 100 has number of pin terminals 102 extending side by side and mounted in a bottom shell part 104. The pin terminals 102 are have similar functional features to the pin terminal 50 but are physically smaller and are formed of thinner sheet metal.

The plug 100 may be provided with a magnet in a similar manner to the plug of FIGS. 1 to 5.

Figure 20:
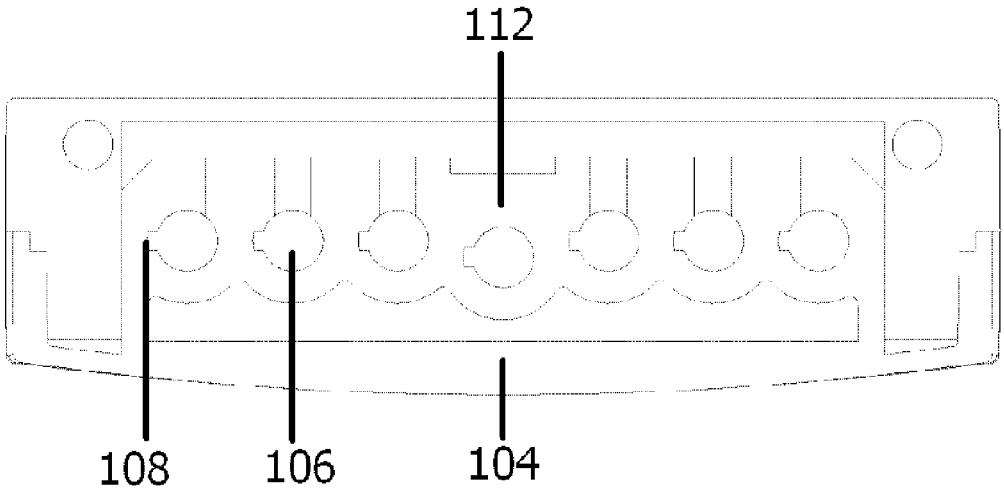
FIG. 20 is cross sectional view of the bottom shell part of the connector of FIG. 18.
Figure 21:
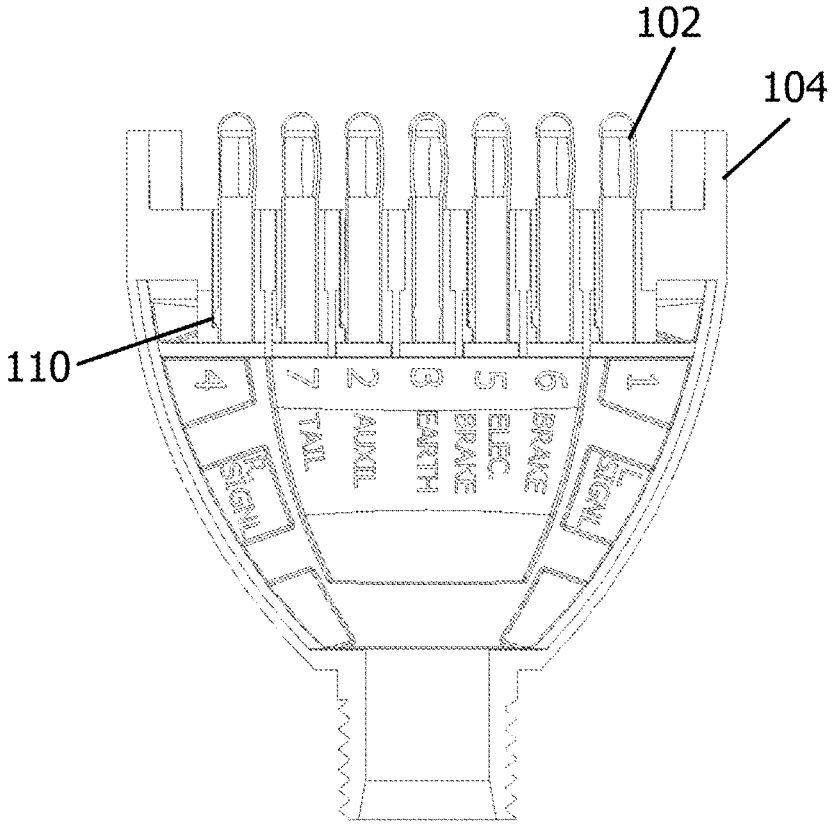
FIG. 21 is a partial plan cross section taken along line BB of FIG. 19.
Figure 25:
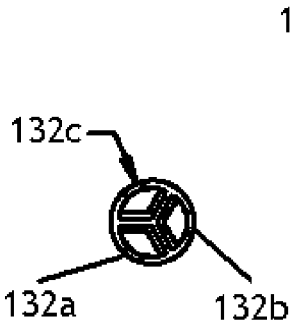
FIG. 25 is an end view from the front of the terminal of FIG. 22.
Figure 22:
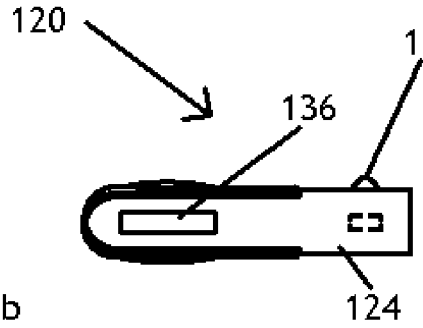
FIG. 22 is a side view of a terminal according to another implementation of the invention.
Figure 24:
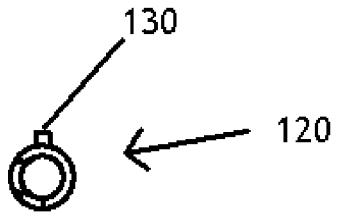
FIG. 24 is an end view from the rear of the terminal of FIG. 22.
Figure 23:
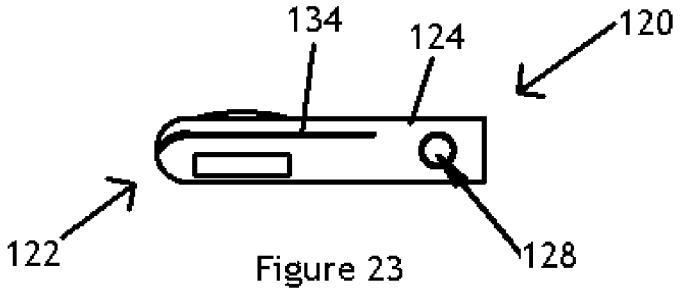
FIG. 23 is a plan view from below of the terminal of FIG. 22.

The bottom shell part 104 has a series of openings 106 into which the pin terminals 102 are received. As seen in FIG. 20 each opening 106 has a groove 108 that receives protrusion 110 of pin terminal 102. Protrusion 110 corresponds to protrusion 66 of terminal 50.

Each opening 106 also has an opening 112 for receiving a screw 114. When the pin terminal 102 is inserted into the opening 106 the opening 112 aligns with opening 116 in terminal 102.

In this embodiment the opening 112 is sized so that the thread of screw 114 engages the opening 112 and screw 114 is retained in the shell 104 by its engagement with the shell 104. The screw is preferably a clearance fit with opening 116 in terminal 102. The screw clamps a wire (not shown) between itself and the opposing wall of the terminal 102 and also retains the terminal within the opening 106 against pull out or push out.

In the preferred form the carrier is formed and the formed rolled terminals are inserted into the carrier. The carrier may be moulded or otherwise formed about the rolled terminals, such as in a plastics injection moulding machine.

A rolled terminal 120 according to another implementation is shown in FIGS. 22 to 25. The terminal 120 is formed from sheet metal that has been rolled into a cylindrical form.

The terminal 120 is a pin adapted to be inserted into complementary socket, such as terminal 52 of FIGS. 11 to 14. The pin 120 includes a connection portion 122, which connects with connection portion 56 of socket 52.

The pin terminal 120 has a wire connection portion 124 for receiving an electrical wire or cable.

The wire connection portion 124 is provided with an anti-rotation outer surface. In this implementation the connection portion is generally cylindrical but has a portion of the wall pressed outwards to form protrusion 130.

The wire connection portion 124 has an aperture 128 that is to allow a screw to pass into the interior of the connection portion and sandwich a cable of wire within between the screw and the opposing wall of the connection portion 124.

The connection portion 122 is formed of three arms 132*a*, *b* and *c*. These arms are generally cylindrical and each extends about ⅓ of the way around the circumference. The arms 132 are separated by gaps 134 and thus may flex radially inwards or outwards. This provides a more progressive and more consistent fit between the male and female terminals. Although the preferred implementation has three arms, other numbers of arms may be used, such as 2, 4, 5, 6, etc.

Each arm 132 has a portion 136 of its wall pushed radially outwards that engages the inner surface of a corresponding socket.

The foregoing features of the invention may be combined in any combination of features where features are not mutually exclusive.

The invention provided the cost saving of rolled terminals whilst providing the reusability of a machined terminal.

It will be apparent to those skilled in the art that many obvious modifications and variations may be made to the embodiments described herein without departing from the spirit or scope of the invention.

Unless the context clearly requires otherwise, throughout the description and any claims the words 'comprise', 'comprising', and the like are to be construed in an inclusive sense as opposed to an exclusive or exhaustive sense; that is to say, in the sense of "including, but not limited to".

The invention claimed is:

1. An electrical plug for a towed vehicle, the electrical plug including:

a main plug body adapted to receive a cable at one end, the main plug body having an outer wall;

a plug portion at the other end of the main plug body which in use connects to a cooperating electrical socket on a tow vehicle, the plug portion comprising connector terminals for making electrical connection with cooperating connector terminals on the cooperating electrical socket; and a first magnet for temporarily securing the electrical plug to the towed vehicle when the electrical plug is not in use;

wherein the first magnet is molded into the outer wall of the main plug body or wherein the first magnet is disposed in a recess in a portion of the outer wall of the main plug body.

2. The electrical plug in accordance with claim 1 further including a second magnet molded into the outer wall of the main plug body or disposed in a recess in a portion of the outer wall of the main plug body and spaced from the first magnet.

3. The electrical plug in accordance with claim 1 wherein the main plug body is a molded plug.

4. The electrical plug in accordance with claim 1 wherein one or more of the connector terminals are constructed from sheet metal.

5. The electrical plug in accordance with claim 1 wherein the plug includes a multi-part shell adapted to house the connector terminals.

6. The electrical plug in accordance with claim 4 wherein the sheet metal connector terminals further include:

a first portion in the form of a hollow cylinder for receiving an electrical wire, and a first aperture in the wall of the first portion for receiving a screw for clamping the wire between the screw and the wall of the first portion.

7. The electrical plug in accordance with claim 6 wherein the sheet metal connector terminals further include a second portion for engagement with a complementary terminal for making the electrical connection with the cooperating connector terminals.

8. The electrical plug in accordance with claim 7 including a second portion integral with the first portion and defining a socket for engagement with a pin of a complementary terminal or a pin for engagement with a socket of a complementary terminal.

9. The electrical plug in accordance with claim 6 wherein the first aperture is sized so the screw is either a clearance or interference fit in the aperture.

10. The electrical plug in accordance with claim 6 wherein the connector terminal includes at least one member to prevent or limit rotation about a longitudinal axis when mounted in a carrier and/or align the terminal in the carrier.

11. The electrical plug in accordance with claim 6 wherein a part of the first portion has a non circular cross section.

12. The electrical plug in accordance with claim 11 wherein the first portion has a generally circular cross section with at least one protrusion extending outwards to define the at least one member.

13. The electrical plug in accordance with claim 6 further including:

a carrier on or in which at least one of the connector terminals is mounted, the carrier including a second aperture that aligns with the first aperture of the or each at least one connector terminal, and a screw located in the second aperture for clamping a wire between the screw and the wall of the first portion.

14. The electrical plug in accordance with claim 13 wherein the screw engages at least one of the first aperture and the second aperture.

15. The electrical plug in accordance with claim 13 wherein a separate threaded component is associated with the second aperture to form at least part of the second wall of the second aperture.

16. The electrical plug in accordance with claim 15 wherein the separate threaded component is embedded in the body of the carrier.

17. The electrical plug in accordance with claim 15 wherein the separate threaded component includes a threaded metal nut.

18. The electrical plug in accordance with claim 13 wherein the second aperture is a bore formed in the body of the carrier.

19. The electrical plug in accordance with claim 13 wherein the at least one terminal is located in a third bore in the carrier, the third bore intersecting with the second aperture.

20. The electrical plug in accordance with claim 19 wherein the third bore is open at both ends.

* * * * *